US006804495B2

(12) United States Patent
Duthie

(10) Patent No.: US 6,804,495 B2
(45) Date of Patent: Oct. 12, 2004

(54) WIRELESS COMMUNICATOR LINK FROM TOWED/SURROGATE DECOY TRANSMITTER TO THE HOST AIRCRAFT

(75) Inventor: Joseph S. Duthie, Algonquin, IL (US)

(73) Assignee: Northrop Grumman Corporation, Los Angeles, CA (US)

( * ) Notice: Subject to any disclaimer, the term of this patent is extended or adjusted under 35 U.S.C. 154(b) by 593 days.

(21) Appl. No.: 09/972,380

(22) Filed: Oct. 5, 2001

(65) Prior Publication Data

US 2003/0068981 A1 Apr. 10, 2003

(51) Int. Cl.[7] ..... G01S 7/38; G01S 13/76; B64D 1/04; H04B 17/00

(52) U.S. Cl. ..... 455/67.11; 342/9; 342/14; 342/173; 244/3.1; 244/3.12; 244/3.14

(58) Field of Search ..... 455/67.11, 67.15, 455/68, 69; 342/5, 6, 9, 11, 12, 13, 14, 15, 169, 170, 171, 172, 187; 244/2, 3, 3.1, 3.12, 3.14, 3.16, 3.17; 89/1.11

(56) References Cited

U.S. PATENT DOCUMENTS

| | | | | |
|---|---|---|---|---|
| 2,557,900 A | | 6/1951 | Wallace, Jr. | |
| 2,649,262 A | | 8/1953 | Fahrney | |
| 4,354,419 A | | 10/1982 | Patterson | |
| 4,808,999 A | | 2/1989 | Toman | |
| 5,112,006 A | | 5/1992 | Palmer | |
| 5,136,295 A | | 8/1992 | Bull et al. | |
| 5,188,313 A | | 2/1993 | Piasecki | |
| 5,260,820 A | | 11/1993 | Bull et al. | |
| 5,786,786 A | * | 7/1998 | Small | 342/13 |
| 6,384,700 B1 | * | 5/2002 | Craine et al. | 333/240 |
| 6,683,555 B2 | * | 1/2004 | Carlson et al. | 342/14 |
| 6,739,232 B2 | * | 5/2004 | Porter et al. | 89/1.11 |

* cited by examiner

*Primary Examiner*—Binh Tieu
(74) *Attorney, Agent, or Firm*—Stetina Brunda Garred & Brucker

(57) ABSTRACT

The present invention relates to a towed/surrogate decoy transmitter connectable via the tow cable to a platform or host aircraft using a wireless communicator link, the link providing useful performance and status information of the decoy transmitter to the host aircraft and providing the decoy with control and optimization information from the platform. The tow cable provides a mechanical connection to the host aircraft as well as a prime power connection and in some cases, a fiber optic (FO) interface. In order to optimize the protection provided by the towed/surrogate decoy transmitter, the host aircraft will use the wireless communication link to transmit operational status and control adjustment data back to the towed/surrogate decoy transmitter. The towed/surrogate decoy transmitter utilizes a wireless communicator link that can transmit data to any cooperative host aircraft and any other cooperative towed/surrogate decoy transmitters.

26 Claims, 7 Drawing Sheets

Embodiment # 1 (Preferred) - Independent RF Transmitter and Wireless Communication Assets and Dedicated ECM FO Cable

Embodiment # 1 (Preferred) - Independent RF Transmitter and Wireless Communication Assets and Dedicated ECM FO Cable Embodiment # 1 (Preferred) - Independent RF Transmitter and Wireless Communications Assets and Dedicated ECM FO Cable Embodiment # 2 (Alternate) - Shared RF Transmitter and Wireless Communication Assets and Dedicated ECM FO Cable Embodiment # 2 (Alternate) - Shared RF Transmitter and Wireless Communications Assets and Dedicated ECM FO Cable (*) Required if the Host Aircraft Does Not Have On-board ECM Transmitter Assets Embodiment # 3 (Alternate) - Shared RF Transmitter and Wireless Communication Assets and no FO Cable

Embodiment # 3 (Alternate) - Shared RF Transmitter and Wireless Communications Assets and No ECM FO Cable

(*) Required if the Host Aircraft Does Not Have On-board ECM Transmitter Assets

Cooperative (Shared) ECM Transmitter Assets

WIRELESS COMMUNICATOR LINK FROM TOWED/SURROGATE DECOY TRANSMITTER TO THE HOST AIRCRAFT

CROSS-REFERENCE TO RELATED APPLICATIONS (Not Applicable)

STATEMENT RE: FEDERALLY SPONSORED RESEARCH/DEVELOPMENT (Not Applicable)

FIELD OF THE INVENTION

The present invention relates to a towed/surrogate decoy transmitter connected via a tow cable to a platform or host aircraft and in communication using a wireless communicator link, the wireless link providing useful performance and status information of the decoy transmitter to the host aircraft. The tow cable provides a mechanical connection to the host aircraft as well as a prime power connection and in some cases, a fiber optic (FO) interface. In order to optimize the protection provided by the towed/surrogate decoy transmitter, the host aircraft will use the wireless communication link to transmit operational status and control adjustment data back to the towed/surrogate decoy transmitter. The towed/surrogate decoy transmitter utilizes a wireless communicator link that can transmit data to any cooperative host aircraft and any other cooperative towed/surrogate decoy transmitters.

BACKGROUND OF THE INVENTION

Military aircraft operating in hostile airspace require protection against radio frequency (RF) based tracking missiles. One method of providing the needed protection is through the use of a towed/surrogate transmitter. This towed/surrogate transmitter may be dropped, fired, towed or otherwise deployed from the aircraft to be protected. The towed/surrogate transmitter acts as a decoy for the RF based tracking missile, resulting in the missile missing its target, the host aircraft, by a sufficient distance to result in survival of the host aircraft from the attack although the decoy may be sacrificed to save the aircraft.

It is important to ensure optimal performance of the decoy. However, without feedback on the operational status of the decoy, back to the host aircraft, the host aircraft is not warned of a failure and may not take the appropriate action to sever the decoy and deploy an operational replacement. Without any decoy operational status feedback, it is also difficult for several host aircraft to cooperate with one another for an optimal defense, where the transmitter assets of multiple aircraft can be shared to offer greater protection.

Towed/surrogate decoys presently communicate with the host aircraft in one of two ways. The first method is the use of fiber optic (FO) cable. For a two-way communication link using fiber optic cables, both the decoy and host aircraft must contain optical lasers and detectors. This method is expensive, because extensive modifications would be required in both the already existing decoy and host aircraft, and the complexity of a two-way link precludes it from being used in low cost, high volume decoy applications. For this reason, all current fiber optic towed decoys employ only a one-way fiber optic communications link from the host aircraft to the decoy, and optimization of the decoy operational performance is difficult. The FO interface between the host aircraft and the decoy is primarily used to relay the RF electronic countermeasure (ECM) information to the high power transmitter resident in the decoy. If the FO interface were to be used to relay decoy control information, the transmission of critical RF data, required to protect the aircraft from a missile attach, would be interrupted during the time that it takes to send the information to the decoy control circuitry.

The second method for a two-way communication link is through the use of a modem. The modem can be used in two ways. It can be used to superimpose the communication signals onto one of the prime power lines. This first modem realization requires that a modem and a means of coupling must be present on both the decoy and the host aircraft. The second modem realization requires that a modem must be present on both the decoy and host aircraft and a dedicated wire link must also be used. The wire link is typically at least two wires. This method is also expensive, because extensive modifications would be required in the already existing decoy, host aircraft, and the tow line (the adding of 2 wires). Some fiber optic towed decoys employ only a one-way modem communications link from either the host aircraft to the decoy, or from the decoy to the host aircraft. Lack of an easily implementable 2-way communication link to exchange operational status and control adjustment data between the decoy and host aircraft complicates the optimization of the ECM systems.

The decoy can also operate as a simple repeater. As a repeater, there is usually not any need for an aircraft communications interface. However, the optimization of decoy performance could benefit from such an interface.

SUMMARY OF THE INVENTION

An improved method of communications between a towed transmitter and the host aircraft to protect an aircraft against RF based tracking threats from a hostile source is disclosed. In order to deceive the RF based tracking radar, a towed/surrogate decoy transmitter is towed behind the platform or aircraft and the RF transmission is radiated by the decoy transmitter instead of the transmitters on board the aircraft. The RF based tracking missile will then lock on to the decoy transmitter instead of the aircraft. Depending on the type of tracking missile being defended against, the RF protection system can employ a variety of RF modulation schemes, called techniques, which prove effective against the particular threat. In order to be able to properly modulate the RF signal, the aircraft protection system needs to receive the operating status of the transmitter located in the towed decoy. This updated knowledge of the operating status will allow the protection system to optimize the transmitter RF drive signal from the aircraft or to command, via the control adjustment data, the decoy control circuitry to change.

In order to eliminate or minimize RF radiations/transmissions emanating from the host aircraft itself, the RF ECM signal, that is generated by the ECM system on-board the host aircraft, is transmitted by the towed/surrogate decoy transmitter. The signal generated by the host aircraft ECM system is transmitted through a FO cable within the tow line. Due to size and weight considerations of alternate means of transmission, fiber optics is normally used to transmit the RF signal to the towed/surrogate decoy transmitter. Due to size and cost constraints, associated with high quality lasers and detectors, the fiber optic path is typically a one-way communication link only from the host aircraft to the decoy. The only methods for the aircraft to monitor the RF transmission is to either receive the signal itself or be able to monitor transmitted signals through the use of detectors on the decoy. However, even if the host aircraft could monitor the RF transmission of the decoy using detectors on the decoy, there is no communication link, from the host aircraft to the decoy, to permit any operational parameters of the decoy transmitter to be adjusted.

It is important to ensure optimal performance of the decoy. However, without feedback on the status of the decoy back to the host aircraft, the host aircraft may not detect a failure or non-optimal operating performance in time to take appropriate action, from a simple parameter adjustment to severing the decoy and deploying a replacement.

The present invention has added a two-way RF communication link, for the purpose of sharing decoy status and operational performance of the decoy with the host aircraft. The transceivers of the two-way RF communication link can be separate circuits from the decoy transmitter circuitry. Using present cellular technology, the cost and miniaturization of the circuitry has already been achieved. The other advantage of separate circuitry, including radiating apertures/antennas, is that the operational parameters can be modified, while the towed/surrogate decoy transmitter is transmitting its RF ECM transmission to the RF based tracking radar/missile. However, it is also possible to inject the RF communication signals into the high power transmission path and utilize the existing transmitter assets and radiating aperture.

This communication link is used to monitor and potentially adjust the operational parameters of the towed/surrogate decoy transmitter. Built-In-Test (BIT) circuitry is utilized in the towed/surrogate decoy transmitter to monitor the operational parameters. As an example, power detectors that measure the radiated RF output power can be included in the radiating apertures of the transmitter. If the BIT circuitry on-board the decoy indicates that the decoy is not functioning properly, the host aircraft could be warned of the failure and appropriate action can be taken. The action taken may be to send operational adjust data to correct the operational performance or to sever the decoy and deploy an operational replacement.

In order to correct the operational performance, operational control circuitry in the decoy will process the operational adjust data from the host aircraft. The BIT circuit will monitor the modified performance and send this data to the transceivers for communication with the host aircraft.

If the towed/surrogate decoy transmitter is a simple repeater without a FO communication link to the host aircraft, the host aircraft could still receive the signal transmitted from the decoy and provide operational adjust data for the decoy operational control circuitry to process.

The host aircraft contains a host RF wireless transceiver to link with the decoy RF wireless transceiver. The performance information received by the host RF wireless transceiver is passed to the host aircraft operational control circuitry. This electronic circuitry on-board the host aircraft can process the performance data from the decoy, take appropriate corrective actions (i.e. sending control adjustment data, or severing the decoy and deploying another decoy). This information is transmitted from the host RF wireless transceiver for communication with the decoy RF wireless transceiver. For the purpose of optimizing the RF ECM signal effectiveness, the host aircraft operational control circuitry can adjust the RF input signal driving the towed decoy transmitter or any necessary adjustment, including, but not limited to modulation or signal strength. This RF input signal is transmitted through the FO tow line to the towed/surrogate decoy transmitter, where the signal is amplified for RF transmission.

The RF wireless communication signals can be transmitted to other aircraft, or towed/surrogate decoy transmitters for an optimized cooperative protection strategy.

DETAILED DESCRIPTION

Figure 1:
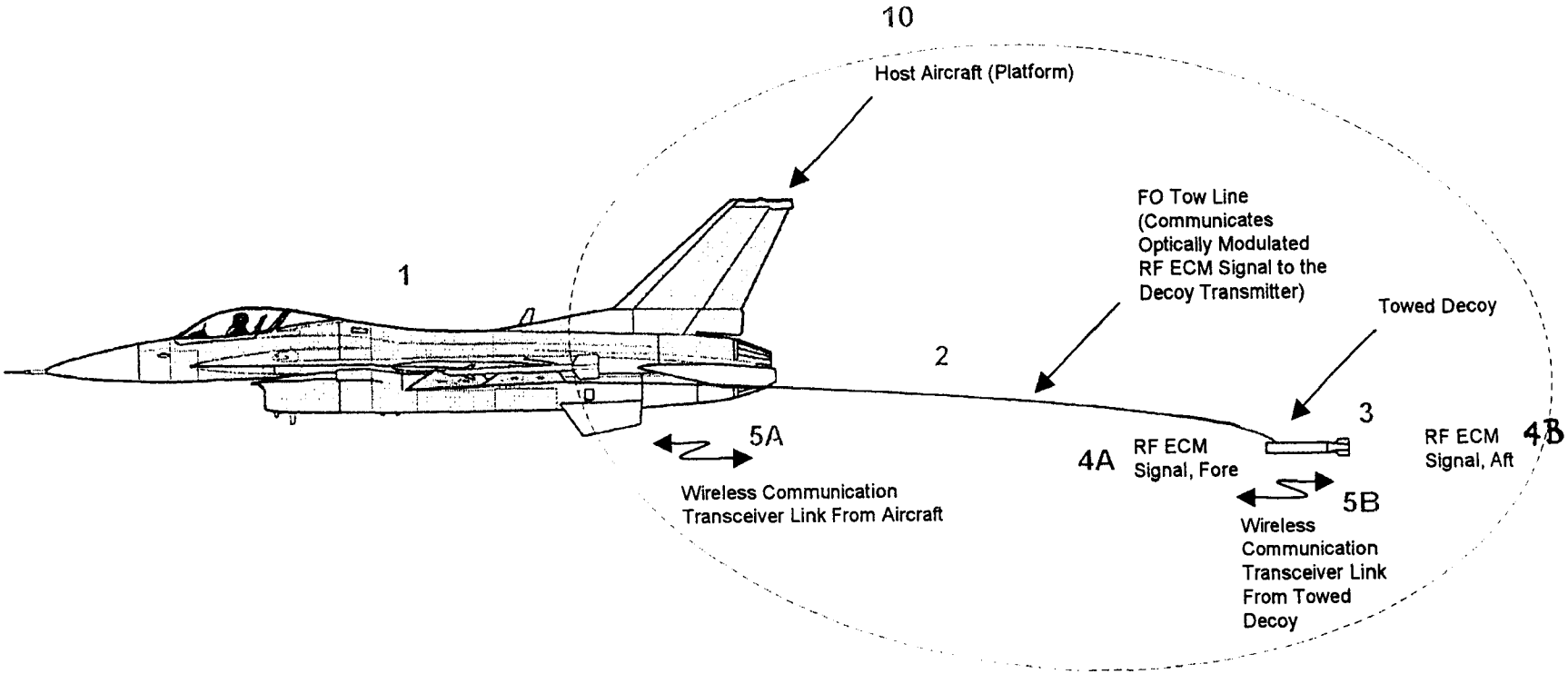
FIG. 1 is a pictorial view of the preferred embodiment of the present invention of the host aircraft towing the towed/surrogate decoy transmitter.

FIG. 1 illustrates the basic components, the preferred embodiment, for a defensive ECM system 10 against RF based tracking missiles using a towed/surrogate decoy transmitter 3. The ECM system 10 is made up of a platform or host aircraft 1 connected to one end of a tow line 2, and the other end connected to a towed/surrogate decoy transmitter 3. By transmitting a RF ECM output transmission signal 4A fore and 4B aft from the decoy transmitter 3, instead of from the host aircraft 1, the RF based tracking missile will lock onto the decoy transmitter 3 instead of the host aircraft 1. The decoy transmitter 3 is towed far enough behind the host plane, so that if any incoming missile destroys the decoy transmitter 3, the host aircraft 1 will survive the explosion. The RF ECM signal 4A is the fore RF ECM transmission from the towed decoy 3. 5A and 5B are the two-way wireless communicator link (5) between the host aircraft 1 and the decoy transmitter 3. If the decoy transmitter 3 is not functioning optimally, the host aircraft 1 can then use the communication link 5 to correct any operational problems, or if necessary, the defective/non-operation decoy can be severed and another decoy transmitter 3 can then be deployed.

Figure 2:
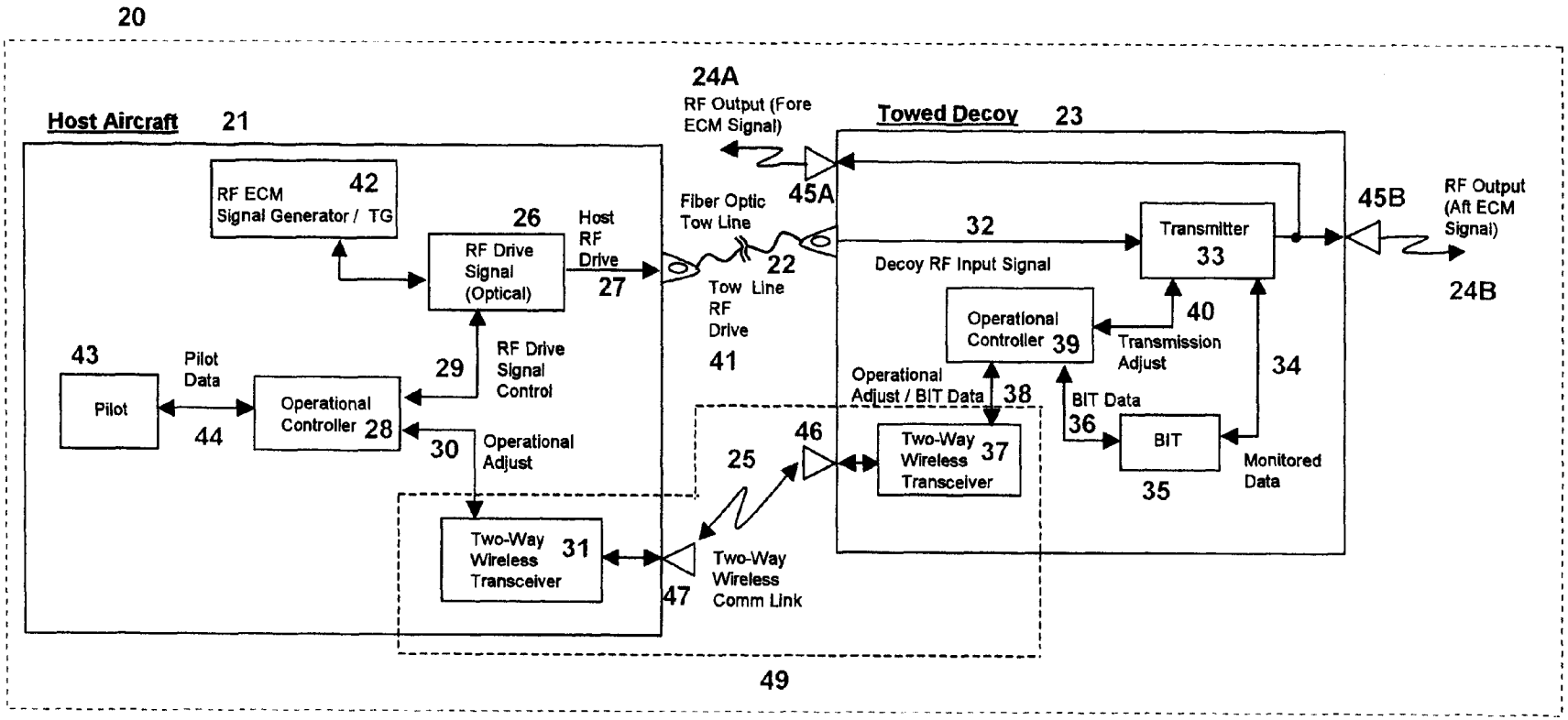
FIG. 2 is a block diagram representation of the preferred embodiment of the host aircraft towing the towed/surrogate transmitter.

FIG. 2 illustrates a block diagram of the preferred embodiment of a two-way wireless transmission link for the defensive ECM system 20 of the defensive protection system 10 in FIG. 1. The wireless communication system 49 of the present invention is the portion depicted within the dashed lines. The host RF drive signal 27 is generated in the host aircraft 21 and rather than being transmitted from the host aircraft, the signal 27 is transmitted through the tow cable 22 to the decoy transmitter 23. Methods of transmission though the tow cable 22 are well known in the industry and include the use of fiber optics, modems or coaxial cables to name a few. Decoy transmitter 23 will then transmit the RF ECM output transmission 24A and 24B, making the host aircraft 21 appear to be at a different location than it actually is. A two-way wireless link 25 is utilized by the host aircraft 21 to monitor the performance parameters of the towed decoy 23 and the host aircraft 21 will provide control signals to optimally adjust the parameters of the towed decoy 23.

The host aircraft 21 contains the RF drive signal circuitry 26 to generate the host RF drive signal 27. This signal 27 is then transmitted through the FO cable contained within the tow line 22 and is labeled as the tow line RF drive signal 41. As the tow line RF drive signal 41, is transmitted to the towed decoy 23, the signal becomes the decoy RF input signal 32. The decoy RF input signal 32, received from the tow line 22, is fed into the transmitter 33. The transmitter 33 contains circuitry for amplification, modulation (if not already performed by the host aircraft) and transmission of the decoy RF input signal. The output of the transmitter 33 is the RF ECM output transmission 24A and 24B, which correspond to RF ECM outputs 4A and 4B in FIG. 1.

The operational controller 28 on-board the host aircraft 21, can also output data to adjust the operational controller 39 located in the towed decoy 23. The output of the operational controller 28 utilizes the operational adjust lines 30, which are an input to the wireless transceiver 31 of the host aircraft 21. The host aircraft wireless transceiver 31 then transmits through the two-way wireless link 25 to the towed decoy wireless transceiver 37. The decoy 23 wireless transceiver 37 then outputs this data onto the operational adjust lines 38, for input to the operational control 39. The operational control 39 then outputs transmission adjust signals 40 to the transmitter 33, to modify the operational parameters desired.

The operational control 39 can also modify any adjustable decoy 23 performance parameter to the required specification. In this case, any signals outputted from the host aircraft operational control 28 and transmitted back to towed decoy operational control 39 through transceivers 31 and 37, would be used to modify the operational performance of the decoy 23.

BIT (Built-In-Test) circuitry 35 is used to monitor the performance specifications of transmitter 33, through the monitored data lines 34. The monitored data lines 34 can provide data on selected performance parameters, which include but are not limited to small signal gain, output power or modulation. One method to measure the radiated power from the transmitter is to include power detectors in the radiating apertures 45A and 45B. This data is then outputted by the BIT 35 as a BIT data signal 36 to the operational control circuitry 39. Operational control circuitry 39 then outputs the BIT data on the operational adjust/BIT data lines 38 into the towed/surrogate decoy wireless transceiver 37. The towed/surrogate decoy wireless transmitter 37, then transmits through the two-way wireless link 25, which corresponds to the two-way wireless communication link 5 (5A and 5B) in FIG. 1, to the host aircraft wireless transceiver 31. The two-way wireless link 25 does not use any of the aircraft RF ECM signal generator circuitry 42 including the RF driver 26, the tow line 22, nor the towed decoy transmitter 33 circuitry. The transceivers 31 and 37 are not contained within the aircraft RF ECM signal generator 42 nor the decoy transmitter 33, and therefore utilize an additional radiating aperture or antenna 46 and 47 in the two-way wireless communication link 49. The host aircraft wireless transceiver 31 than outputs the data received through the two-way wireless link 25 as the operational adjust signal lines 30 to the RF drive signal circuitry 26. The operational controller 28, then determines what changes are necessary and can send commands, through the RF drive signal control lines 29, to either adjust a performance parameter or check a performance parameter. This information can also be provided to the pilot display 43 through the control lines, pilot data 44. The pilot can then override any potential commands from the operational control 28. The pilot could then determine if the towed decoy performance was acceptable, needs modification, or if a new towed decoy 23 were required. The operational controller 28 can autonomously effect all operational performance adjustments or decided to deploy a new decoy.

Figure 3:
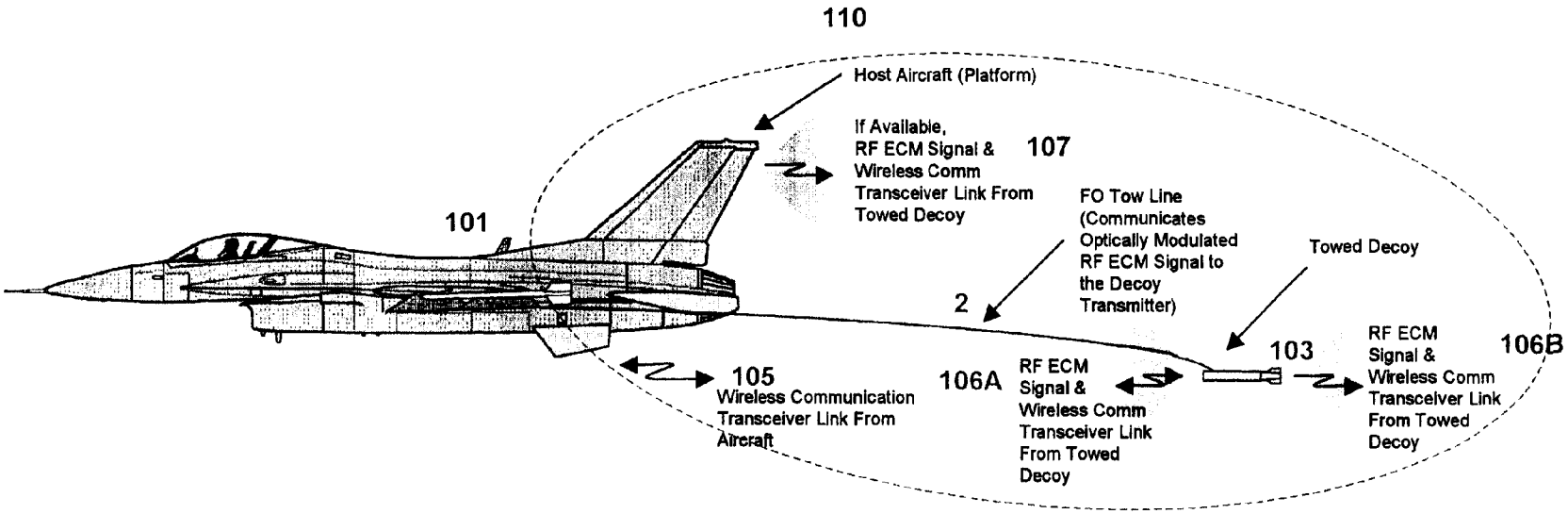
FIG. 3 is a pictorial view of an alternate embodiment utilizing shared RF transmitter and wireless communication assets.

FIG. 3 illustrates the second embodiment of the invention in which the wireless communications link of a defensive ECM system 110 between the host aircraft 101 and the decoy 103 can be accommodated by the sharing of the RF ECM transmitter circuitry (i.e., the amplifier and antenna assets) 107 and 106A. The FO tow line 2 communicates the optically modulated RF ECM signal to the decoy transmitter 103. If the communication link 107 is not available, then the wireless communication link 105 is required to realize this embodiment of the invention.

Figure 4:
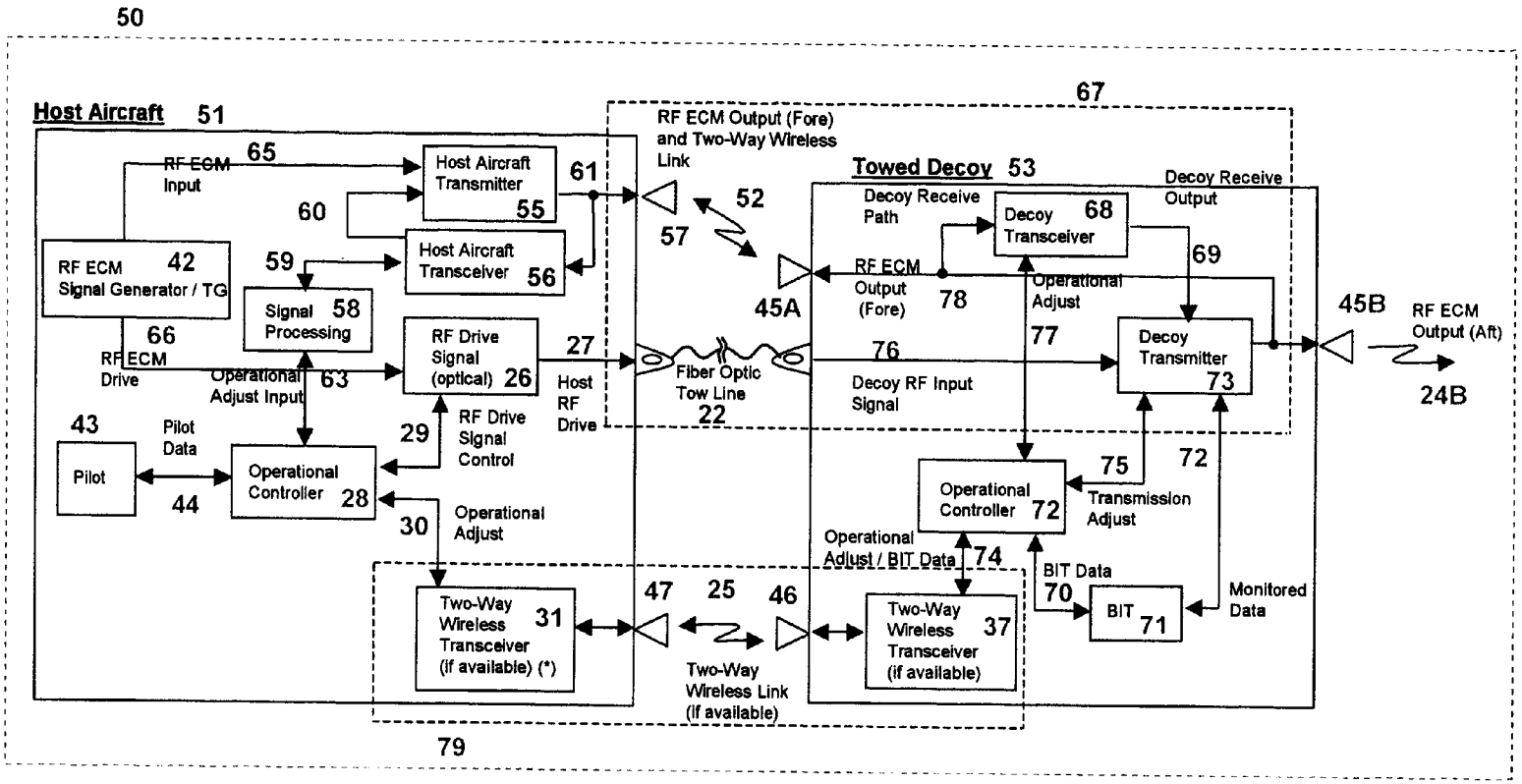
FIG. 4 is a block diagram representation of the alternate embodiment illustrated in FIG. 3.

FIG. 4. Illustrates a block diagram of a defensive ECM system 50, wherein there need not be a stand alone two-way wireless transceivers 31 and 37 to transmit status of operational performance information 74 from the decoy 53 and operational adjust 30 from the host platform 51. The two-way wireless link 49, from the preferred embodiment shown in FIG. 2, would not be available. Instead the two-way wireless link 52 would utilize the on-board RF ECM antenna 57 on the host aircraft 51, and a decoy antenna 45A on the decoy 53. The antenna 45A would receive the host aircraft RF output 52 to the decoy transceiver 68. The decoy transceiver 68 would provide the decoy receive output 69 to the decoy transmitter 73 for RF ECM output aft 24B. A portion of the transmitted signal would also be transmitted towards the host aircraft 51 via antenna 45A via line 78. The decoy transceiver 68 is also in communication with the operational controller 72 through the operational adjust lines 77. The operational controller 72 then uses the transmission adjust lines 75 to adjust the transmission of the decoy transmitter 73.

The host aircraft 51 has a RF transmitter 55 that transmits the RF ECM input signal from the RF ECM generator/TG 42 to the antenna 57 and through the RF ECM Output (fore) and two-way wireless link 52. The host aircraft still provides the decoy RF input signal 76 through the FO tow cable 22. The host aircraft also has a host aircraft transceiver 56 connected to the same output path. This transceiver 56 provides the input to and receives output from the signal processing 58. Signal processing 58 provides operational adjust input 63 to operational controller 28 and receives operational adjust input 63 back from the operational controller 28.

Figure 5:
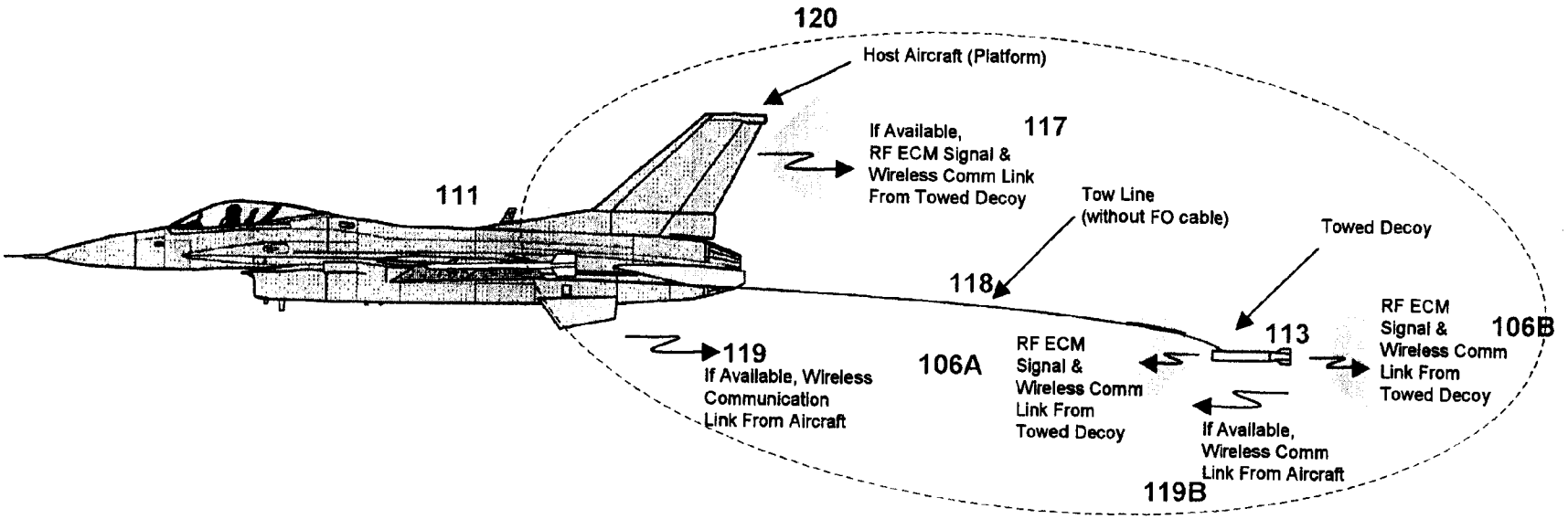
FIG. 5 is a pictorial view of an alternate embodiment utilizing the towed/surrogate decoy as a repeater.

FIG. 5 illustrates a third alternate embodiment of this invention in which the wireless communication link 117 includes the RF ECM signal including the RF decoy control and optimization signal. The reason for including the RF input signal is that the tow cable 118 does not include a FO connection between the host aircraft 111 and the decoy 113. In other words, the decoy 113 acts as a repeater, receiving the radar signal and amplifying the signal before retransmitting. In fact, the cable line can be eliminated from the system if the decoy contains a self-contained prime power source (i.e., a battery), and is not to be towed, the towed decoy version 113 uses the host aircraft 111 for propulsion and prime power. Other embodiments would use a surrogate decoy transmitter 113, that is either fired or released for a limited time deployment. Like the second alternate embodiment, if the on-board transmitter assets are available, the wireless communication link 119 is therefore not utilized. A communication link is critical to optimize the performance of the decoy transmitter 113.

Figure 6:
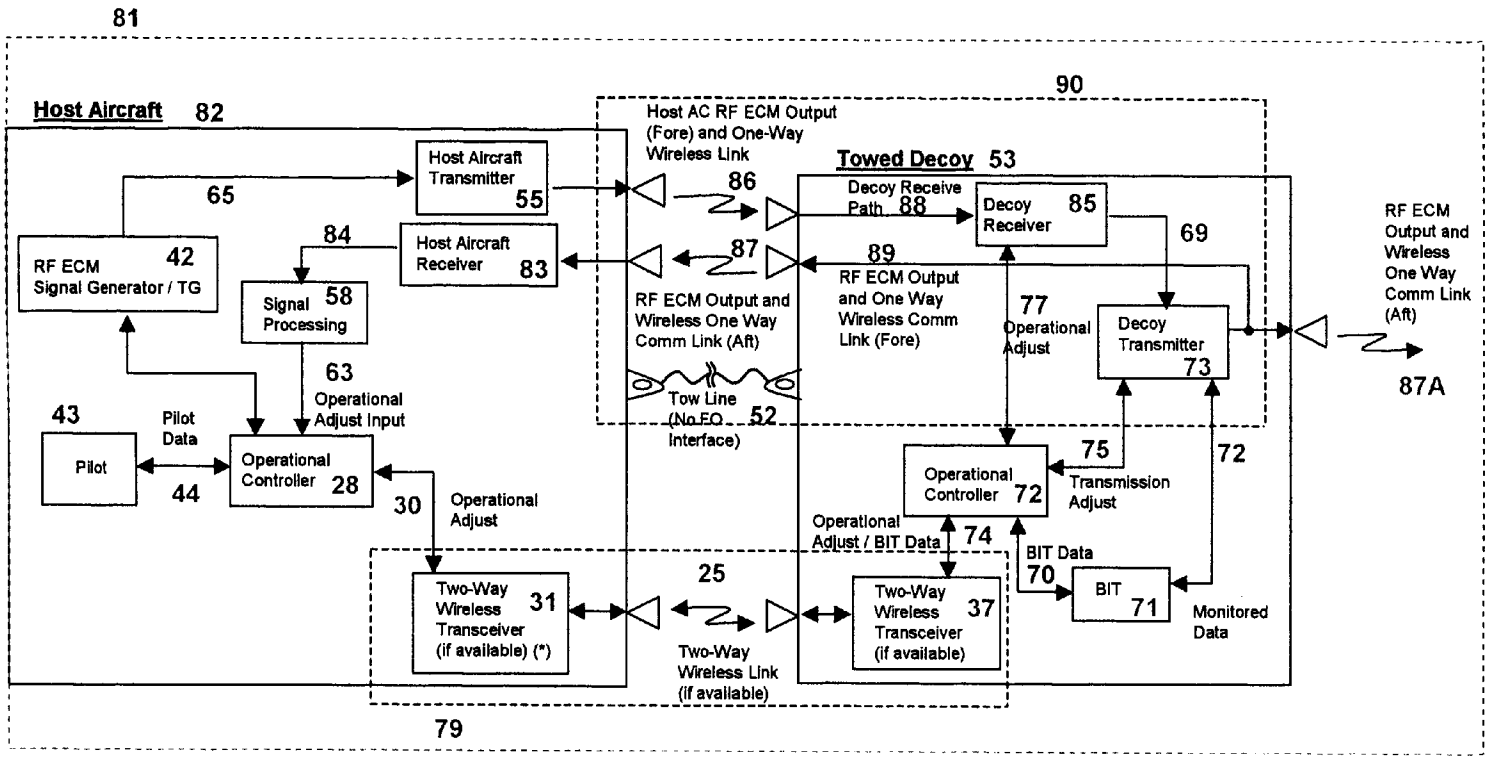
FIG. 6 is a block diagram representation of the alternate embodiment illustrated in FIG. 5.

FIG. 6 shows the block diagram for the third alternate embodiment. The tow line 52 has no FO interface. The link to provide the operational adjust parameters can occur through either of two paths. If the host aircraft 82 does not have on-board ECM transmitter assets, then the two-way link 79 is used. If the host aircraft 82 has shared RF transmitter and wireless communication assets, then the link 90 is used. The difference between the link 90 in FIG. 6 and link 67 in FIG. 4 is due to the lack of FO interface in the tow line 52. This requires the host aircraft RF ECM output (fore) and one-way wireless link 86 to provide the decoy control and optimization RF input signal through decoy receive path 88 to decoy receiver 85. Decoy receiver 85 provides the decoy RF input signal to the decoy transmitter 73 through lines 69. Link 87 provides the decoy RF ECM output and wireless one-way link (aft) to the host aircraft receiver 83. The host receiver 83 then outputs this information to the signal processing 58.

Figure 7:
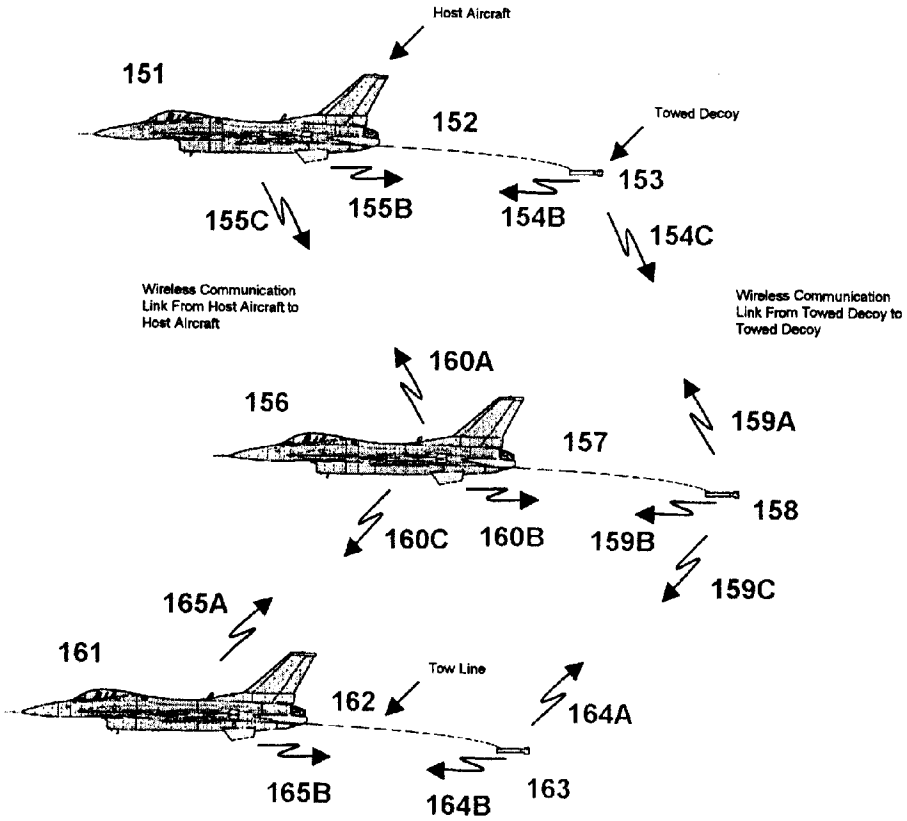
FIG. 7 is an pictorial view of multiple host aircraft and towed/surrogate decoy transmitters using wireless communication in a cooperative technique (sharing transmitter assets) to protect aircraft under hostile threats.

FIG. 7 illustrates the multiple communication paths among multiple host aircraft and decoys. Through the use of multiple paths, data from any host aircraft or decoy can be received and retransmitted by another host aircraft or decoy. This permits a master host aircraft, that is in overall control of the deployment strategy, to control any decoy RF ECM signal. The determination of the overall master host aircraft can be determined or changed as required.

In the illustration, host aircraft are labeled 151, 156 and 161, each having a corresponding decoy labeled as 153, 158 and 163 respectively. A one-way communication from the host aircraft through the tow lines to the decoys are labeled as group set (host aircraft, tow line, decoy) 151, 152 and 153,156, 157 and 158, and 161, 162 and 163. In this illustration, host aircraft 151 is the master host aircraft. Each of the towed decoys 153, 158 and 163 have two-way wireless communication links, 154, 159 and 164, respectively. Each of the host aircraft 151, 156 and 161 have two-way communication links, 155, 160 and 165, respectively. Any of the aircraft or decoys can receive wireless data from and retransmit wireless data to the other towed decoys or any aircraft. The direction of the links is indicated by letters A, B and C which are added to the corresponding link number. A letter A indicates that the direction is to an aircraft or decoy above the transmitting decoy or aircraft. A letter B indicates that the direction is between an aircraft and the towed decoy. A letter C indicates that the direction is towards an aircraft or decoy that is below the transmitting aircraft or decoy. Master host aircraft 151 can communicate with decoy 163 directly through communication link 155B, or through communication link 155C to aircraft 156, then aircraft 156 can retransmit through communication link 160B to decoy 158 and then decoy 158 can retransmit though communication link 159C to decoy 163. The exact communication path is not critical to the control of the cooperative ECM transmitter assets.

Although preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. A communication system between a platform and a towed/surrogate decoy transmitter, capable of monitoring and controlling the towed/surrogate decoy transmitter output RF ECM transmission comprising:

a) a tow line, having at least one communication conductor extending therethrough, the tow line having a first end connected to the platform and a second end connected to the decoy transmitter, such that the tow line provides a structural and an one-way communication link between the platform and the towed/surrogate decoy transmitter; and b) the towed/surrogate decoy transmitter, connected to the second end of the tow line, further comprising a wireless two-way RF communication link between the platform and the towed/surrogate decoy transmitter, said link providing a performance data path for performance data from the towed/surrogate decoy transmitter to the platform and an operational adjust data path for operational adjust data from the platform to the towed/surrogate decoy transmitter.

2. The system as recited in claim 1, in which the one-way communication link further comprises an optical transmitter on the platform, an optical receiver on the towed/surrogate decoy transmitter, and a fiber optic cable extending therethrough the tow line.

3. The system as recited in claim 1, in which a power cable in the tow line, said power cable, extending therethrough the tow line, such that the tow line provides power to the towed/surrogate decoy transmitter.

4. The system as recited in claim 3 in which the wireless two-way RF communication link further comprises a decoy RF wireless transceiver, and a host RF wireless transceiver, such that the transceivers provide the performance data path and the operational control adjustment data path.

5. The system as recited in claim 4, in which the wireless two-way RF communication link further comprises a decoy operational controller, the decoy operational controller is in communication with the decoy RF wireless transceiver, such that the decoy operational control will process the operational control adjustment data received by the decoy RF wireless transceiver from the platform RF wireless transceiver and change any required operating parameters of the towed/surrogate decoy transmitter.

6. The system as recited in claim 5, in which the wireless two-way RF communication link further comprises a BIT (Built-In-Test) circuitry, the BIT circuitry is in communication with the decoy operational control, such that the BIT circuitry provides the performance data to the decoy operational control from performance monitoring circuitry within the decoy transmitter, the decoy operational controller outputting the performance data for transmission to the platform through the decoy RF wireless transceiver.

7. The system as recited in claim 6, further comprises a decoy transmitter circuitry, a decoy transmitter circuitry input is in communication with the tow line communication conductor, such that the tow line communication conductor provides a signal path for a decoy RF input signal to the decoy transmitter circuitry.

8. The system as recited in claim 7, further comprises a decoy antenna, the decoy antenna is in communication with the decoy transmitter circuitry, such that after the decoy RF input signal has been processed, it is retransmitted from the decoy antenna instead of from the platform.

9. The system as recited in claim 8, in which the BIT circuitry further comprises a power detector that is located in a radiating aperture of the towed/surrogate decoy transmitter.

10. The system as recited in claim 9, in which the RF wireless transceivers utilize a separate antenna from the RF ECM transmission antenna used by the platform or the towed/surrogate decoy transmitter.

11. The system as recited in claim 9, in which the operational adjust data is injected onto a RF ECM high power transmit path of the platform, to be received by a RF transceiver on the towed/surrogate decoy transmitter.

12. The system as recited in claim 10, in which said towed/surrogate decoy RF wireless transceiver and said platform rf wireless transceiver receive from and retransmit to a plurality of platform RF wireless transceivers and a plurality of decoy RF wireless transceivers.

13. The system as recited in claim 11, in which said towed/surrogate decoy RF wireless transceiver and said platform rf wireless transceiver receive from and retransmit to a plurality of platform RF wireless transceivers and a plurality of decoy RF wireless transceivers.

14. A communication system between a platform and a towed/surrogate decoy transmitter, acting as a repeater, capable of monitoring and controlling the towed/surrogate decoy transmitter output RF ECM transmission comprising:

a) a tow line, having at least one power conductor extending therethrough, the tow line having a first end connected to the platform and a second end connected to the decoy transmitter, such that the tow line provides a structural and a power link between the platform and the towed/surrogate decoy transmitter; and b) the towed/surrogate decoy transmitter, connected to the second end of the tow line, further comprising a wireless two-way RF communication link between the platform and the towed/surrogate decoy transmitter, said link providing a performance data path of a performance data from the towed/surrogate decoy transmitter to the platform and an operational adjust data path of an operational control adjustment data from the platform to the towed/surrogate decoy transmitter.

15. The system as recited in claim 14, in which the RF ECM transmission from the decoy originates from the transmission of a RF based tracking radar.

16. The system as recited in claim 15 in which the wireless two-way RF communication link further comprises a decoy RF wireless transceiver, and a host RF wireless transceiver, such that the transceivers provide the performance data path and the operational control adjustment data path.

17. The system as recited in claim 16, in which the wireless two-way RF communication link further comprises a decoy operational controller, the decoy operational controller is in communication with the decoy RF wireless transceiver, such that the decoy operational control will process the operational control adjustment data received by the decoy RF wireless transceiver from the platform RF wireless transceiver and change any required operating parameters of the towed/surrogate decoy transmitter.

18. The system as recited in claim 17, in which the wireless two-way RF communication link further comprises a BIT (Built-In-Test) circuitry, the BIT circuitry is in communication with the decoy operational controller, such that the BIT circuitry provides the performance data to the decoy operational control for monitoring performance parameters and outputting the performance data for transmission to the platform by the decoy RF wireless transceiver.

19. The system as recited in claim 18, further comprises a decoy antenna, the decoy antenna is in communication with the decoy transmitter circuitry, such that the RF input signal, is amplified and is retransmitted from the decoy antenna instead of from the platform.

20. The system as recited in claim 19, further comprises a communication path between the BIT circuitry and the decoy transmitter circuitry, such that the BIT circuitry monitors performance parameters of the towed/surrogate decoy transmitter.

21. The system as recited in claim 20, in which the BIT circuitry further comprises a power detector that is located in a radiating aperture of the towed/surrogate decoy transmitter.

22. The system as recited in claim 21, in which the RF wireless transceivers utilize a separate antenna from a RF ECM transmission antenna used by the platform or the towed/surrogate decoy transmitter.

23. The system as recited in claim 21, in which said towed/surrogate decoy RF wireless transceiver and said platform RF wireless transceiver receive from and retransmit to a plurality of platform RF wireless transceivers and a plurality of decoy RF wireless transceivers.

24. The system as recited in claim 22, in which said towed/surrogate decoy RF wireless transceiver and said platform RF wireless transceiver receive from and retransmit to a plurality of platform RF wireless transceivers and a plurality of decoy RF wireless transceivers.

25. A method for providing a RF wireless communication link between a platform and a towed/surrogate decoy transmitter, the steps comprising:

a) connecting the first end of a towline from the platform and the second end to the towed/surrogate decoy transmitter;

b) transmitting a RF drive signal from the platform through the tow line to the physically attached towed/surrogate decoy transmitter;

c) transmitting an RF ECM transmission from the towed decoy, to deceive a RF based tracking radar, generated from the RF drive signal;

d) monitoring the RF transmission operational parameters utilizing BIT circuitry;

e) transmitting a performance data of the operational parameters of the RF transmission from the decoy RF wireless transceiver to the platform RF wireless transceiver;

f) processing all of the transmitted performance data by platform; and g) transmitting an operational control adjustment data to the decoy RF wireless transceiver of the towed/surrogate decoy transmitter;

h) processing the operational control adjustment data in the towed/surrogate decoy transmitter to adjust the operational parameters; and i) transmitting an adjusted RF ECM transmission.

26. A method for providing a RF wireless communication link between a platform and a towed/surrogate decoy transmitter, acting as a repeater, the steps comprising:

a) connecting the first end of a towline from the platform and the second end to the towed/surrogate decoy transmitter;

b) providing power from the platform through the tow line to the physically attached towed/surrogate decoy transmitter;

c) retransmitting a RF ECM transmission, established from a separate RF based tracking radar source, from the towed decoy, to deceive the RF based tracking missile;

d) monitoring the RF transmission operational parameters by a BIT circuit;

e) transmitting a performance data of the operational parameters of the RF transmission from the decoy RF wireless transceiver to the platform RF wireless transceiver;

f) processing all of the transmitted performance data by platform; and g) transmitting an operational control adjustment data to the decoy RF wireless transceiver of the towed/surrogate decoy transmitter;

h) processing the operational control adjustment data in the towed/surrogate decoy transmitter to adjust the operational parameters; and i) transmitting an adjusted RF ECM transmission, established from the separate RF based tracking source.

* * * * *